United States Patent [19]

Klukos

[11] 4,191,110

[45] Mar. 4, 1980

[54] SHELF CONSTRUCTION

[76] Inventor: Edward O. Klukos, 3284 Roosevelt Rd., Muskegon, Mich. 49441

[21] Appl. No.: 2,243

[22] Filed: Jan. 10, 1979

[51] Int. Cl.[2] ..... A47B 17/00

[52] U.S. Cl. ..... 108/27; 108/152; 211/88; 248/235

[58] Field of Search ..... 108/27, 152; 211/88, 211/90; 248/235, 205 R

[56] References Cited

U.S. PATENT DOCUMENTS

| | | | |
|---|---|---|---|
| 2,431,752 | 12/1947 | Hilstrom | 211/88 X |
| 2,453,387 | 11/1948 | Rundell | 211/90 X |
| 2,839,201 | 6/1958 | Auster | 211/88 X |
| 2,942,924 | 6/1960 | Stangert | 108/27 X |
| 3,239,272 | 3/1966 | Wilkins | 211/88 X |
| 3,662,982 | 5/1972 | Antonius | 211/88 X |

FOREIGN PATENT DOCUMENTS

| | | | |
|---|---|---|---|
| 837463 | 3/1952 | Fed. Rep. of Germany | 211/88 |
| 1335491 | 7/1963 | France | 211/88 |

*Primary Examiner*—Roy D. Frazier

*Assistant Examiner*—Peter A. Aschenbrenner

*Attorney, Agent, or Firm*—Price, Heneveld, Huizenga & Cooper

[57] ABSTRACT

A shelf construction includes a pair of vertically extending end supports mounted in spaced parallel relationship to a rear support surface and including a plurality of vertically spaced horizontally extending support rods extending between the end supports. Mounted to the support rods is a rod receiving integral shelf and bracket including a forwardly facing socket with a lower leg extending downwardly from the socket, an upper leg extending rearwardly from the socket, and a middle leg comprising the rear portion of the socket and extending vertically between the upper and lower legs. Both lower and upper legs extend rearwardly against a rear support surface to wnich the end supports are secured a distance such that the upper and lower legs force the socket into lockable engagement with the support rod. Integrally formed with the upper leg is a horizontally extending tray for holding objects on the integral shelf and bracket so formed.

22 Claims, 4 Drawing Figures

SHELF CONSTRUCTION

BACKGROUND OF THE INVENTION

The present invention relates to shelf construction and more particularly to an integral shelf and bracket.

There exists in the prior art a variety of storage systems which provide a stationary horizontal surface for storage of objects. One common system uses horizontally extending short end support projections extending from the sidewalls of a storage container and between which a flat shelf is supported. Such shelf structure does not provide a front lip to prevent items from being forced off the edge of the shelf, nor does it provide a stable shelf particularly when long shelves are needed.

There exists a variety of shelf systems for use in the storage of items, for example, in a door of a refrigerator or the like. Representative of such constructions are U.S. Pat. Nos. 2,453,387, 2,528,807, 2,717,819, 3,233,744, 3,822,925, and Great Britain Pat. No. 851,667.

One handy but frequently unused area for storage is the space behind a door where the door opens against a wall. To fully utilize such space, several vertically spaced shelves are desirable. If prior art shelf constructions were used in this convenient location, several support brackets for mounting separate shelves are needed. Although prefabricated cabinets are available for such application, they do not provide design freedom frequently necessary. Thus, there is a need for a shelf construction which can be sold in kit form for installation by a homeowner and one which provides sturdy, easily installed multiple shelves with design freedom for individual installations.

SUMMARY OF THE INVENTION

The shelf construction which is the subject of the present invention satisfies this need by providing an integral shelf and bracket which is easily mounted to a simple support rod and results in an extremely stable shelf.

In accordance with the present invention, a shelf construction utilized for storing objects includes an integral shelf and bracket for mounting to a rod extending between a pair of vertically extending end supports mounted in spaced parallel relationship to a rear support surface. The rear support surface can comprise a door, however, it could consist of a wall, the back of a closet, or any suitable surface. The integral shelf and bracket includes a forwardly facing socket with a rear leg extending downwardly from the socket and an upper leg extending rearwardly from an upper portion of the socket. Both legs extend rearwardly for engagement against the rear support surface to which end support members are secured a distance such that the upper and lower legs compressibly force the shelf socket into lockable engagement with the support rod. Integrally formed with the upper leg is a horizontally extending tray for holding objects on the shelf so formed.

Preferably, the rod receiving shelf and bracket extends from one vertically extending end support to the other vertically extending end support, although smaller sections of the integral shelf and bracket as described can be used as brackets to support a cross-piece which itself serves as the shelf surface.

Preferably the integral shelf and bracket is extruded of a resilient material so that it can be easily cut to length and snap-locked into position. Such construction allows the shelf to be sold in kit form with the associated end supports and rods fitted in a compact package for shipping.

These and other features, objects, and advantages of the present invention can best be understood by reference to the following description thereof together with the drawings in which:

DETAILED DESCRIPTION OF THE PREFERRED EMBODIMENT

Figure 1:
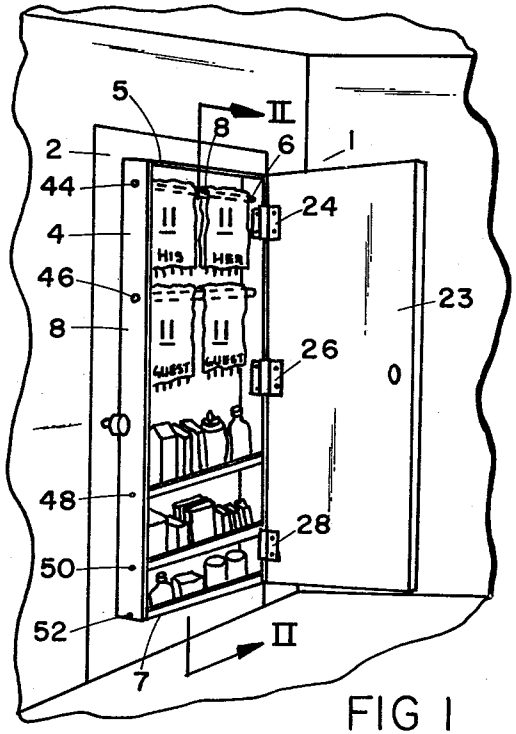
FIG. 1 is a perspective view of the shelf construction of the present invention mounted to the back side of a door.
Figure 3:
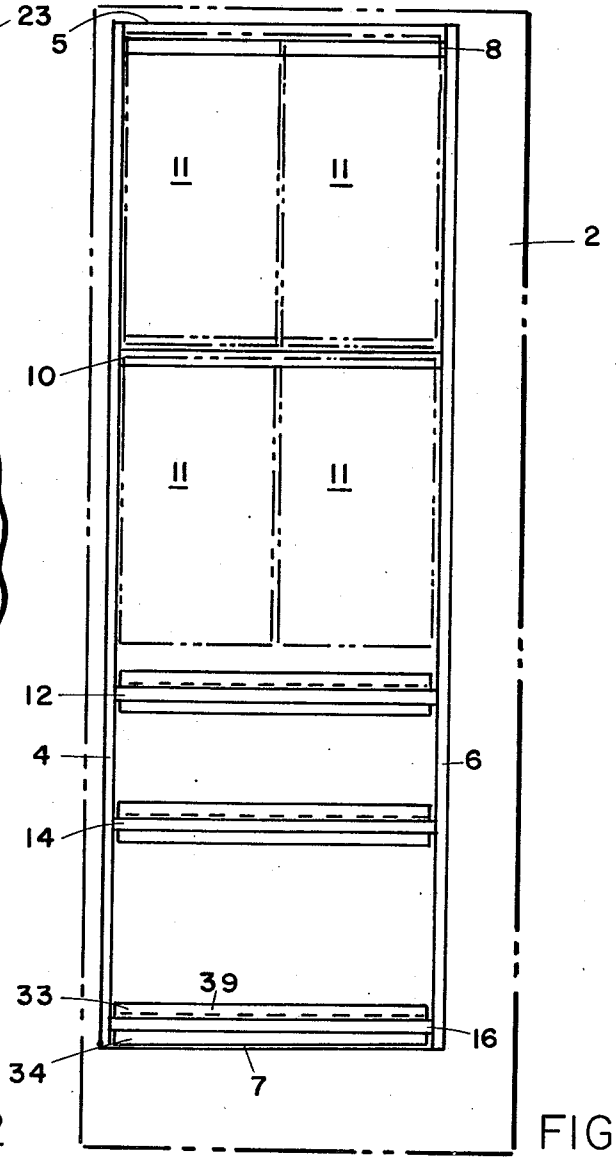
FIG. 3 is a front view of the shelf construction shown in FIG. 1.
Figure 2:
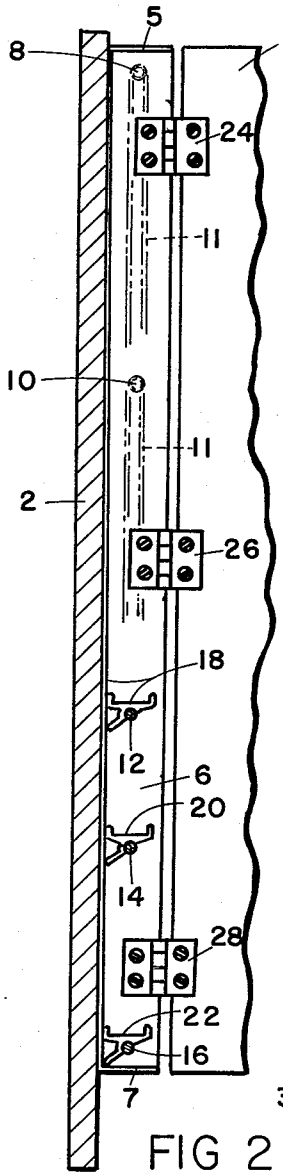
FIG. 2 is a fragmentary vertical cross-sectional view taken along the section lines II—II of FIG. 1.

FIGS. 1 through 3 illustrate a storage unit 1 embodying the shelf construction of the present invention for use on the rear of a door 2 serving as a support surface. The storage unit 1 includes a pair of vertically extending end supports 4 and 6 mounted in spaced parallel relationship to door 2 by means of commercially available mounting clips such as those used for assembling prefabricated panels. The end supports are, in the preferred embodiment, made of rectilinear wooden pieces. The dimensions of end supports typically can be 1"×3"×5' in the embodiment shown. Top and bottom panels 5 and 7, respectively, extend between the end supports and are secured thereto to form an enclosure which is closed by a door 23. The cover panel or door 23 for the storage unit 1 is hinged to end support 6 by hinges 24, 26, and 28, as seen in FIGS. 1 and 2.

Extending between end support members 4 and 6 and connected to them by conventional mounting means are a plurality of vertically spaced horizontally extending support rods 8, 10, 12, 14, and 16. In the preferred embodiment, the end supports 4 and 6 have a plurality of apertures 44, 46, 48, 50, and 52 (FIG. 1) with a diameter selected such that the support rods can be frictionally fitted into and held between the end supports. The apertures 44, 46, 48, 50, and 52 and additional apertures (not shown) allow the support rods to be adjusted to a variety of selectable vertical positions. As shown in FIGS. 1 and 2, support rods 8 and 10 are utilized to support towels 11 or other articles which can be hung over the rods. The remaining rods 12, 14, and 16 in FIGS. 2 and 3 are utilized to support the novel integral shelf and brackets 18, 20, and 22. In the preferred embodiment, the support rods are made out of glass, although numerous other materials such as aluminum or steel rods, either solid or hollow, are suitable.

Having briefly described the overall construction of a storage unit embodying the present invention, a detailed description of the unique integral shelves and brackets 18, 20, and 22 and their cooperation with the support rods 12, 14, and 16, respectively, is now presented.

Figure 4:
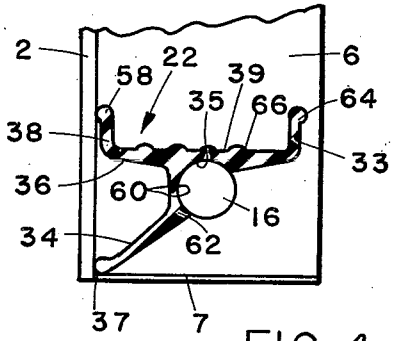
FIG. 4 is a fragmentary enlarged cross-sectional view of an individual integral shelf and bracket as shown in FIG. 2.

FIG. 4 is a fragmentary enlarged view of the cross section of the lower integral shelf and bracket 22 as shown in FIG. 2. Referring particularly to FIG. 4, mounted to the support rod 16 is an integral shelf and bracket 22 which includes a forwardly facing semicylindrical socket 35 with an integral lower leg 34 extending downwardly from the socket 35 at an angle of about 45°. Leg 34 terminates in a rounded tip 37. An upper leg 36 is integral with the tray or support surface 39 and extends rearwardly from the upper end of the socket 35 and includes a vertically extending lip 38 terminating in a rounded tip 58. Extending vertically between the upper leg 36 and lower leg 34 is a middle leg 60 which forms the rear portion of the socket 35. A longitudinally extending, forward facing boss 62 is integrally formed with the lower end of socket 35 and the lower leg 34. The forward face of boss 62 should be smooth and acts as a camming surface to facilitate the installation (hereinafter discussed) of the integral shelf and bracket 22 to the support rod 16.

Both the lower and upper legs 34 and 36 extend rearwardly such that rounded tips 37 and 58 engage the rear support surface 2 to which the end support members 4 and 6 are secured. This rearward distance is selected such that the upper and lower legs compressibly force the shelf socket 35 into lockable engagement circumscribing a significant portion of the support rod 16 (about 180° in the preferred embodiment). As seen in FIG. 4, the socket with its 180° of contact with rod 16 is inclined at about 45° to the vertical such that the rod provides both vertical and horizontal support to the shelf and bracket. Integrally formed with the upper leg 36 is a horizontally extending support surface such as a tray 39 for holding objects on the integral shelf and bracket so formed. Integrally formed along the forward edge of tray 39 is a forward vertical lip 33 with an enlarged rounded edge 64 which lip acts to prevent items from sliding off of tray 39. The surface of tray 39 is composed of a plurality of longitudinally extending raised projections 66 providing a nonskid surface for objects placed on the tray.

The integral shelf and brackets 18, 20, and 22 are inserted into position by placing them above their respective support rods and forcing them downwardly until the resilient sockets 35 snap over and into engagement with their rods. The action is facilitated by the smooth forward facing surface of the longitudinally extending boss 62. The tips of the lower and upper support legs 34 and 36 compressibly force the shelf sockets into lockable engagement with the support rods.

It is, of course, important to assure that the legs 34 and 36 are in compression once the integral shelf and bracket is installed. This is achieved by selecting either the length of the legs to slightly exceed the space between the support surface and the support rods or by mounting the support rods within apertures located to achieve the same effect. The integral shelf and bracket is extruded out of any material sufficiently resilient to deflect and, thus, lockably engage the support rods and could, thus, be plastic or metal such as polyvinyl chloride or aluminum, respectively.

While the above described embodiment utilized an elongated integral shelf and bracket, several shorter lengths of a cross section as shown in FIG. 4 could be utilized in conjunction with a rectangular piece of flat material supported by a plurality of such integral shelf and brackets to achieve the same result. In such construction, lips 33 and 38 could be removed although leg 36 would still compressibly engage the rear support surface. If lips 33 and 38 were retained in such a construction, they would provide transverse support for the shelf. Also, support rods with different cross sections than the round rod disclosed could be used. Thus, for example, square support rods may be employed. In such case, the socket would be shaped in a mating configuration.

It will be understood that various changes in the details, materials, steps, and arrangements of parts which have been herein described and illustrated in order to explain the nature of the invention may be made by those skilled in the art and still fall within the principle and scope of the invention as defined in the appended claims.

The embodiments of the invention in which an exclusive property or privilege is claimed are defined as follows:

1. A shelf construction for storing articles for mounting between a pair of vertically extending end supports mounted in spaced parallel relationship to a rear support surface and including a plurality of vertically spaced, horizontally extending support members extending between the end supports, said construction comprising:

at least one integrated shelf and bracket including means defining a support surface having a forwardly facing socket formed in said integral shelf and bracket for mounting to a support member and rearwardly extending means for engaging the rear support surface for forcibly compressing the socket into lockable engagement with the support member.

2. The shelf construction as defined in claim 1 wherein said rearwardly extending means for forcibly compressing the socket into lockable engagement with a support member comprises a lower leg extending downwardly from said socket and an upper leg extending rearwardly from said socket.

3. The shelf construction as defined in claim 2 wherein said support surface comprises a horizontally extending tray integrally formed with the upper leg.

4. The shelf construction as defined in claim 3 wherein said socket is semicylindrical for circumscribing a portion of a circular cross section support member extending between the end supports.

5. The shelf construction as defined in claim 4 wherein the integral shelf and bracket is an elongated member.

6. The shelf construction as defined in claim 5 wherein said integral shelf and bracket is extruded of a resilient material.

7. The shelf construction as defined in claim 6 wherein said material is PVC.

8. An integral shelf and bracket comprising:

a horizontally extending support surface having one end for engaging a wall;

a first leg extending downwardly from said support surface in spaced relationship to said end wherein the junction of said support surface and said first leg defines a forwardly facing support receiving socket; and a second leg extending downwardly and rearwardly from said first leg for engaging a rear support surface such that said socket is compressibly held into cooperative engagement with a support member with said one end of said horizontal support surface and said second leg providing rotational stability for the integral shelf and bracket.

9. The integral shelf and bracket as defined in claim 8 wherein said one end of said horizontally extending support surface comprises an upper leg extending rearwardly from an upper portion of said socket.

10. The integral shelf and bracket as defined in claim 9 wherein the horizontally extending support surface further comprises a horizontally extending tray and a vertically extending lip on said tray integrally formed with said upper leg.

11. The integral shelf and bracket as defined in claim 10 wherein the forwardly facing support receiving socket is semicylindrical for circumscribing a portion of a support member of circular cross section.

12. The integral shelf and bracket as defined in claim 1 wherein the end of said upper leg has a rounded tip.

13. The integral shelf and bracket as defined in claim 12 wherein said second leg terminates in a rounded tip.

14. The integral shelf and bracket as defined in claim 13 wherein the lower end of said semicylindrical socket and the forward end of the second leg join to define a forwardly facing boss having a camming surface thereon for facilitating mounting of said shelf and bracket to a support rod.

15. The integral shelf and bracket as defined in claim 14 wherein said integral shelf and bracket is extruded of a resilient material.

16. The integral shelf and bracket as defined in claim 15 wherein said material is PVC.

17. An integral shelf and bracket comprising:

forwardly facing socket means for engaging a horizontally extending support member extending between and supported by vertical end supports;

vertically spaced means extending rearwardly from said sockets for compressibly engaging a rear support surface such that the forwardly facing socket means is held in cooperative engagement with a horizontally extending support member; and means coupled to said socket means for holding objects.

18. The integral shelf and bracket as defined in claim 17 wherein the rearwardly extending means comprises an upper leg extending rearwardly from said socket means to engage a rear support surface and a lower leg extending downwardly and rearwardly from said socket means to engage a rear support surface.

19. The integral shelf and bracket as defined in claim 18 wherein the socket means is defined by the junction of a middle leg extending vertically between the upper leg and lower leg and the means for holding objects.

20. The integral shelf and bracket as defined in claim 19 wherein said socket means comprises a semicylindrical socket for circumscribing a portion of the support member of circular cross section which extends between the end supports.

21. The integral shelf and bracket as defined in claim 20 wherein the means for holding objects on the integral shelf and bracket comprises a horizontally extending tray including a vertically extending lip on a forward edge of said tray.

22. A shelf construction for storing articles comprising:

a pair of vertically extending end supports mounted in spaced parallel relationship to a rear support surface;

a plurality of vertically spaced, horizontally extending support rods of circular cross section extending between and supported by said end supports; and an integral shelf and bracket for mounting to the support rods comprising a horizontally extending support surface having an upper leg extending rearwardly for engaging a rear support surface, said upper leg also horizontally extending and terminating at its rear most end in a vertical lip with a rounded tip, said support surface also having a vertical lip along its forward edge, a middle leg extending downwardly from said support surface in spaced relationship to said upper leg wherein the junction of said support surface and said middle leg defines a forwardly facing semicylindrically shaped socket, a lower leg extending downwardly and rearwardly from said middle leg for engaging a rear support surface such that the socket is compressibly held in cooperative engagement with a support rod with said upper leg and said lower leg providing rotational stability for the integral shelf and bracket, said lower leg terminating in a rounded tip, and a forwardly facing boss defining a camming surface at the forward part of the junction of the lower end of said semicylindrical socket and said lower leg.

* * * * *

UNITED STATES PATENT AND TRADEMARK OFFICE

CERTIFICATE OF CORRECTION

PATENT NO. : 4,191,110

DATED : March 4, 1980

INVENTOR(S) : Edward O. Klukos

It is certified that error appears in the above-identified patent and that said Letters Patent are hereby corrected as shown below:

In the abstract:

Line 13: "wnich" should be --which--

Column 3, line 42

"The" should be --This--

Column 5, line 13

"1" should be --11--

Column 5, line 32

"sockets" should be --socket--

Column 6, line 26

"rear most" should be --rearmost--

Signed and Sealed this

*Fifth* Day of *August 1980*

[SEAL]

*Attest:*

SIDNEY A. DIAMOND

*Attesting Officer*

*Commissioner of Patents and Trademarks*